United States Patent [19]

Mine

[11] 4,243,542

[45] Jan. 6, 1981

[54] ELECTRICAL INSULATING COMPOSITIONS CONTAINING ZINC OXIDE AND AN ORGANOSILICON COMPOUND CONTAINING AT LEAST ONE SILICON-HYDROGEN BOND

[75] Inventor: Katsutoshi Mine, Ichihara, Japan

[73] Assignee: Toray Silicone Company, Ltd., Tokyo, Japan

[21] Appl. No.: 74,852

[22] Filed: Sep. 13, 1979

[30] Foreign Application Priority Data

Oct. 3, 1978 [JP] Japan ..... 53-121721

[51] Int. Cl.[3] ..... H01B 3/46; H01B 3/10

[52] U.S. Cl. ..... 260/375 B; 106/287.14; 174/110 R; 174/110 S

[58] Field of Search ..... 252/63.2, 63.5, 63.7; 260/375 B, 42.15; 427/220, 221; 428/405; 106/287.14, 296; 174/110 A, 110 S, 110 AR

[56] References Cited

U.S. PATENT DOCUMENTS

| | | | |
|---|---|---|---|
| 2,717,219 | 9/1955 | Ford et al. | 252/63.2 X |
| 2,999,077 | 9/1961 | Nitzsche et al. | 260/375 B X |
| 3,009,829 | 11/1961 | Gouveia | 260/375 B X |
| 3,882,033 | 5/1975 | Wright | 252/63.5 |
| 3,885,984 | 5/1975 | Wright | 106/287.14 |

*Primary Examiner*—Harris A. Pitlick
*Attorney, Agent, or Firm*—Robert L. McKellar

[57] ABSTRACT

What is disclosed is an electrical insulating material which consists of conventional electrical insulating materials which contain zinc oxide and a silicon compound wherein there is at least one hydrogen atom bound to a silicon atom. The improved compositions give minimal changes in their properties over wide temperature ranges.

14 Claims, 3 Drawing Figures

ELECTRICAL INSULATING COMPOSITIONS CONTAINING ZINC OXIDE AND AN ORGANOSILICON COMPOUND CONTAINING AT LEAST ONE SILICON-HYDROGEN BOND

BACKGROUND OF THE INVENTION

The present invention deals with electrical insulating compositions with an improved electrical insulating property over a wide temperature range and especially in the temperature range from room temperature to high temperatures.

In the field of electrical materials and especially electrical insulating materials, there is great demand for the development of new materials with superior characteristics and for the development of effective treatment techniques for these new materials. There is also great demand for the production of compact electrical instruments, light-weight electrical instruments and highly efficient and highly reliable electrical instruments. Materials which are applicable in this area may exist in three states: gas, liquid and solid. In fact, a variety of insulating materials are used in a variety of forms in electrical instruments.

Materials ranging from organic to inorganic substances are used as electrical insulating materials. Current materials include those which have been used for many years and are considered to be important, those which have been used for many years with considerable improvements and those which have been recently developed as new materials. For example, materials which have been used for many years are natural compounds such as mica, asbestos, quartz, sulfur, linseed oil, minteral oil, paraffin, asphalt and natural rubber. On the other hand, materials which have been recently developed are those which have a variety of organic synthetic polymers as the base material. In particular, the following organic synthetic polymers are used: synthetic rubbers such as ethylene-propylene rubber, chloroprene rubber, styrene-butadiene rubber and silicone rubber; curable resins such as phenol resin, epoxy resin, unsaturated polyester resins and silicone resins and thermoplastic resins such as polyethylene, polypropylene, ABS resin and fluoro resins.

The above-mentioned insulating materials have been utilized in a variety of fields. With the great demand for the production of compact instruments, light-weight instruments and highly efficient and highly reliable instruments, the heat resistance of electrical insulating materials and particularly the maximum allowable temperature for the mechanical properties and electrical insulating properties are significant factors which restrict the instrument operating temperature and output. Therefore, there has been great demand for the development of insulating materials which demonstrate minimal changes in their various properties over a wide temperature range.

Examples of insulating materials with excellent heat resistance are inorganic substances such as mica, ceramics, glass, quartz and cement. Since these materials have poor processability, their application is relatively restricted.

Insulating materials which do not possess as much heat resistance as the above-mentioned inorganic materials but which do possess excellent processability are the following polymers: organic synthetic rubbers such as ethylene-propylene rubber, chloroprene rubber, styrene-butadiene rubber, fluororubber and silicone rubber; curable resins such as phenol resin, epoxy resin, unsaturated polyester resins, polyimides and silicone resins, and thermoplastics resins such as polyesters, polyamides, vinyl chloride resins, polyethylene, polypropylene, polystyrene, polybutadiene, polysulfones, Noryl® resin, diallyl phthalate resins and polycarbonates. These polymers are currently utilized in a variety of fields.

However, the electrical insulating property of the above-mentioned organic materials decreases sharply as the temperature increases. Thus, the upper temperature limit for electrical instruments is largely restricted.

This invention therefore deals with electrical insulating materials having a minimal decline in the electrical insulating property with increasing temperature.

The present invention more specifically concerns an electrical insulating material comprising (A) 100 parts by weight of an organic electrical insulating material; (B) 5–300 parts by weight, based on 100 parts by weight of (A), of zinc oxide powder and, (C) 1–30 weight percent based on the weight of components (B) and (C) of an organosilicon compound in which there is at least one silicon atom having a hydrogen atom bonded thereto.

Component (A), the organic electrical insulating material, can be either a natural organic material such as mineral oil, paraffin, asphalt, or natural rubber or a synthetic organic material. In particular, materials which are solid at room temperature are most preferred. In particular, these materials are rubbers, curable resins and thermoplastic resins. Examples of the rubbers are natural rubber, isoprene rubber, chloroprene rubber, ethylene-propylene rubber, EPDM rubber, styrene-butadiene rubber, butyl rubber, butadiene rubber, acrylic rubber, urethane rubber, silicone rubber, fluororubber, chlorosulfonated polyethylene rubber, epichlorohydrin rubber and epoxy rubber. The curable resins can be either room-temperature curable or heat-curable resins. Examples of such curable resins are phenol resins, epoxy resins, unsaturated polyester resins, alkyd resins, silicone resins, polyurethane resins, melamine resins and polyimide resins. Examples of the thermoplastic resins are polyethylene, polypropylene, polystyrene, polyamide, polyester, polyvinyl chloride, polycarbonate, PMMA, polyacetal and fluororesins.

Component (B), the zinc oxide powder, can be a zinc oxide powder prepared by the French method (indirect method), the American method (direct method) or the wet method. The particle size preferably ranges from 0.1 to 10 microns. The purity of the zinc oxide is preferably greater than 99% although as much as 3% impurities can be tolerated in some cases. If particularly high insulating characteristics are required, even purer zinc oxide powder is preferred. This component is added at 5–300 parts by weight based on 100 parts of the organic insulating material. If the addition is less than 5 parts, the improvement in the electrical insulating property is less. If it exceeds 300 parts, the workability and processability are degraded and the mechanical characteristics change significantly.

Component (C), is an organosilicon compound in which there is at least one silicon atom having a hydrogen atom bonded thereto. This is the component which acts synergistically with the zinc oxide powder to eliminate the decrease in the electrical insulating properties with increasing temperature. These compounds are generally expressed by an average unit formula $R_aH_bSiO_{4-a-b/2}$ in which R represents substituted or unsubstituted hydrocarbon radicals, the hydroxyl group or hydrolyzable groups; a is 0 to less than 4 and b is greater than 0 to 4.

The molecular configurations can be that of simple substances or linear, branched linear, cyclic, network or three-dimensional substances. However, linear or cyclic molecules are the most common. Either homopolymers or copolymers are operable. These polymers are preferably liquids at room temperature.

Examples of the unsubstituted hydrocarbon radicals useful in this invention are methyl, n-propyl, octyl, cyclohexyl, phenyl and vinyl groups. Examples of substituted hydrocarbon radicals useful in this invention are tolyl, xylyl, benzyl, p-chlorophenyl, cyanoethyl and 3,3,3-trifluoropropyl groups. Examples of hydrolyzable radicals useful in this invention are methoxy, ethoxy, n-propoxy, acetoxy, dialkyketoxime and alkylamino groups wherein the alkyl groups have 1–3 carbon atoms.

R preferably represents unsubstituted hydrocarbon radicals. Component (C) is preferably an organohydrogenpolysiloxane. At least one hydrogen atom bonded to a silicon atom must be present per molecule. Preferably, hydrogen is present in such a fashion that b in the above-mentioned formula is at least 0.05. Examples of component (C) useful in this invention are dimethylsilane, trimethylsilane, trimethoxysilane, methyldiethoxysilane, a methylhydrogenpolysiloxane in which both ends are blocked with trimethylsiloxy groups, a copolymer of methylhydrogensiloxane and dimethylsiloxane in which both ends are blocked with trimethylsiloxy groups, a dimethylpolysiloxane in which both ends are blocked with dimethylsiloxy groups, a methylhydrogenpolysiloxane in which both ends are blocked with dimethylsiloxy groups, a methylhydrogenopolysiloxane in which both ends are blocked with dimethyloctyl groups, tetramethyltetrahydrogencyclotetrasiloxane, a methylhydrogenopolysiloxane in which both ends are blocked with dimethylphenylsiloxy groups and a copolymer of methylhydrogensiloxane and methylphenylsiloxane in which both ends are blocked with dimethylphenylsiloxy groups.

The amount of these compounds added to the composition ranges from 1 to 19 weight% based on the components (B) and (C). If this addition is less than 1 weight%, the effect on reducing the decline in the electrical insulating property caused by increasing temperature is poor. On the other hand, if this addition exceeds 30 weight%, the mechanical characteristics and processability of the organic materials are adversely affected.

These above-mentioned two components can be added in any order to the organic insulating material. For example, component (B) is added first and component (C) is then added. Alternatively, this order can be reversed. Components (B) and (C) can be added to each other and then this mixture added to (A). In this case, the above-mentioned two components can be diluted and dispersed, prior to addition, in an appropriate solvent such as toluene, xylene, hexane, or heptane.

Such a mixture must be added to component (A) at an appropriate time, that is, before vulcanization in the case of rubbers; before using in the case of curable resins and as the melt or in solution in the case of thermoplastic resins. The desired effect can be obtained satisfactorily by dispersing and blending both components (B) and (C) homogeneously.

The mixture of components (B) and (C) is allowed to stand at room temperature for more than one day and preferably for 1–7 days or at 180° C. for more than 10 minutes and preferably for 10 minutes to 24 hours. This mixture is then added to the organic material. This allows the desired effect to be obtained more easily. If components (B) and (C) are added to an organic solvent such as toluene and xylene and the mixture is allowed to stand for a while, the organic solvent is removed and the resulting residue is added to the organic material, even more desirable results can be obtained.

The electrical insulating compositions of this invention are useful as electrical insulating materials for various types of electrical parts, electronic parts, electrical instruments and electronic instruments and in particular are useful as electrical insulating materials for parts which are exposed to high temperature.

EXAMPLE 1

Liquid epoxy resin, Chissonox 221, produced by Chisso Co., Ltd. chemical name: 3,4-epoxycyclohexylmethyl-(3,4-chlorohexane)carboxylate, 100 parts by weight, was combined with methyl hamic anhydride, 80 parts, as a curing agent, ethylene glycol, 4 parts, 99% pure zinc oxide powder, 50 parts by weight, with an average particle size of 0.5 microns and a methylhydrogenpolysiloxane, 5 parts by weight (9.1 weight%) in which both ends are blocked with trimethylsiloxy groups and which has a viscosity of 10 cs. This mixture was blended until a homogeneous dispersion was obtained. The resin composition was heated at 150° C. for 24 hours and the composition was cured in sheet form with a thickness of 1.0 mm. The volume resistance was measured according to JIS C-2123. As a comparison example, a composition which did not contain zinc oxide was prepared and a cured product was obtained. A resin composition was prepared in which the methylhydrogenpolysiloxane was omitted from the above-mentioned composition and a cured product was obtained. A cured product of epoxy resin alone was also manufactured. The volume resistance of these cured products was measured according to the same method. The results are presented in FIG. 1. The compositions which contained both zinc oxide powder and a methylhydrogenpolysiloxane in which the ends were blocked with trimethylsiloxy groups was found to demonstrate superior characteristics.

EXAMPLE 2

A polyester resin produced by Toshiba Chemical Co., Ltd. (Tradename: TVB-2122), 100 parts by weight, was combined with TEC-9611, 1.0 parts, as the curing agent; 99% pure zinc oxide powder, 30 parts by weight, with an average particle size of 0.5 microns and tetramethyltetrahydrogencyclotetrapolysiloxane, 5 parts by weight (14.2 weight%) and the mixture was blended until a homogeneous dispersion was obtained. The resulting composition was heated at 100° C. for one hour for curing and the volume resistance was measured by the method of Example 1. For comparison, the following cured products were prepared: cured product of a composition in which zinc oxide powder was omitted from the above-mentioned composition, cured product of the composition in which the tetramethyltetrahydrogencyclotetrasiloxane was omitted from the above-mentioned composition and the cured product of the unsaturated polyester resin alone. The volume resistance of these cured products was measured by the same method. The results are presented in FIG. 2. The composition which contained both zinc oxide powder and tetramethylhydrogencyclotetrasiloxane was found to demonstrate superior characteristics.

EXAMPLE 3

A silicone resin consisting of methylphenylpolysiloxane units containing 5 weight % silanol groups, 100 parts by weight, xylene, 100 parts by weight, and a trace of lead octanoate as the curing catalyst were combined with 99% pure zinc oxide, 50 parts by weight, with an average particle size of 0.5 microns and a copolymer of 10 parts by weight, (16.67 weight%) of dimethylsiloxane, 80 mol%, and methylhydrogensiloxane, 20 mol%. The mixture was blended until a homogeneous dispersion was obtained. The composition was spread out to form a thin layer and left standing at room temperature in order for the xylene to evaporate. The composition was heated at 180° C. for 20 hours for curing and a 100 mm thick sheet was obtained. The volume resistance was measured by the method in Example 1. For comparison, the following cured products were also prepared: the cured product of this composition in which the zinc oxide powder was omitted from the above-mentioned composition, the cured product of this composition in which the dimethylsiloxanemethylhydrogensiloxane copolymer was omitted from the above-mentioned composition, the cured product of the silicone resin alone. The volume resistance of these cured products was measured by the same method. The results are presented in FIG. 3. The composition which contained both zinc oxide powder and the dimethylsiloxanemethylhydrogensiloxane copolymer was found to demonstrate superior characteristics.

EXAMPLE 4

Ethylene/propylene terpolymer produced by Mitsui Petrochemical Co., Ltd. (tradename: EPT-3045), 100 parts by weight, was mixed with process oil, 10 parts by weight, and the mixture was blended well using a two roll mill. A mixture of a methylhydrogenopolysiloxane, 5 parts by weight (9.1 weight%), in which both ends were blocked with trimethylsilyl groups and having a viscosity of 20 cs and zinc oxide produced by Sakai Chemical Co., Ltd. (tradename: Zinc White No. 1), 50 parts by weight, was added to the above mixture and the resulting mixture was blended well using the same two roll mill. Dicumyl peroxide, 4 parts by weight, was added to this mixture and the resulting mixture was blended to obtain a homogeneous mixture. The composition was treated by press vulcanization under the following conditions: temperature 170° C., pressure 30 kg/cm$^2$ for 10 minutes. A 1 mm thick sheet was obtained. This rubber sheet was heat treated in a hot-air circulating oven at 150° C. for 3 hours. The volume resistance of the product was measured according to JIS C-2125. For comparison, a rubber sheet of this composition in which the methylhydrogenpolysiloxane was omitted and a rubber sheet of this composition in which talc was added, instead of zinc oxide, were prepared and their volume resistance was measured by the same method. The results are presented in Table I.

EXAMPLE 5

An organopolysiloxane raw rubber, 100 parts by weight, consisting of $(CH_3)_2SiO$ units (99.8 mol%) and $(CH_3)(CH_2{=}CH)SiO$ units (0.2 mol%) and in which both ends were blocked with trimethylsilyl groups was combined with a mixture of methylhydrogenpolysiloxane, 3 parts (9.1 weight%), in which both ends were blocked with trimethylsilyl groups and which had a viscosity of 20 cs and 30 parts of the above-mentioned Zinc White No. 1. The mixture was thoroughly blended using a two roll mill. 2,4-dichlorobenzoyl peroxide paste, 2 parts, with a purity of 50%, was added to the mixture. The resulting composition was treated by press vulcanization under the following conditions: temperature 120° C., pressure 30 kg/cm$^2$ for 10 minutes. A 1.0 mm rubber sheet was obtained. The rubber sheet was further heat treated in a hot-air circulating oven at 200° C. for 4 hours. The volume resistance of this rubber sheet was measured by the method in Example 4. For comparison a rubber sheet of this composition in which the methylhydrogenpolysiloxane was omitted was prepared and its volume resistance was measured. The results are presented in Table II.

EXAMPLE 6

Commercial polycarbonate resin chips (100 parts) were melted under nitrogen gas. A mixture of the above-mentioned Zinc White No. 1, 60 parts, and a methylhydrogenopolysiloxane, 3 parts, (4.76 weight%) in which both ends were blocked with trimethylsilyl groups and having a viscosity of 20 cs was added to this melt and the resulting mixture was thoroughly blended by stirring. After cooling, a 1.0 mm thick sheet was formed. The volume resistance was measured according to JIS C-2123. The results obtained were as follows: $1.2\times10^{15}$ ohm-meter at 25° C., $6\times10^{15}$ ohm-meter at 100° C. and $1\times10^{14}$ ohm-meter at 140° C. The polycarbonate sheet alone gave the following results: $9\times10^{14}$ ohm-meter at 25° C., $8\times10^{13}$ ohm-meter at 100° C. and $7\times10^{12}$ ohm-meter at 140° C.

TABLE I

Figure 1:
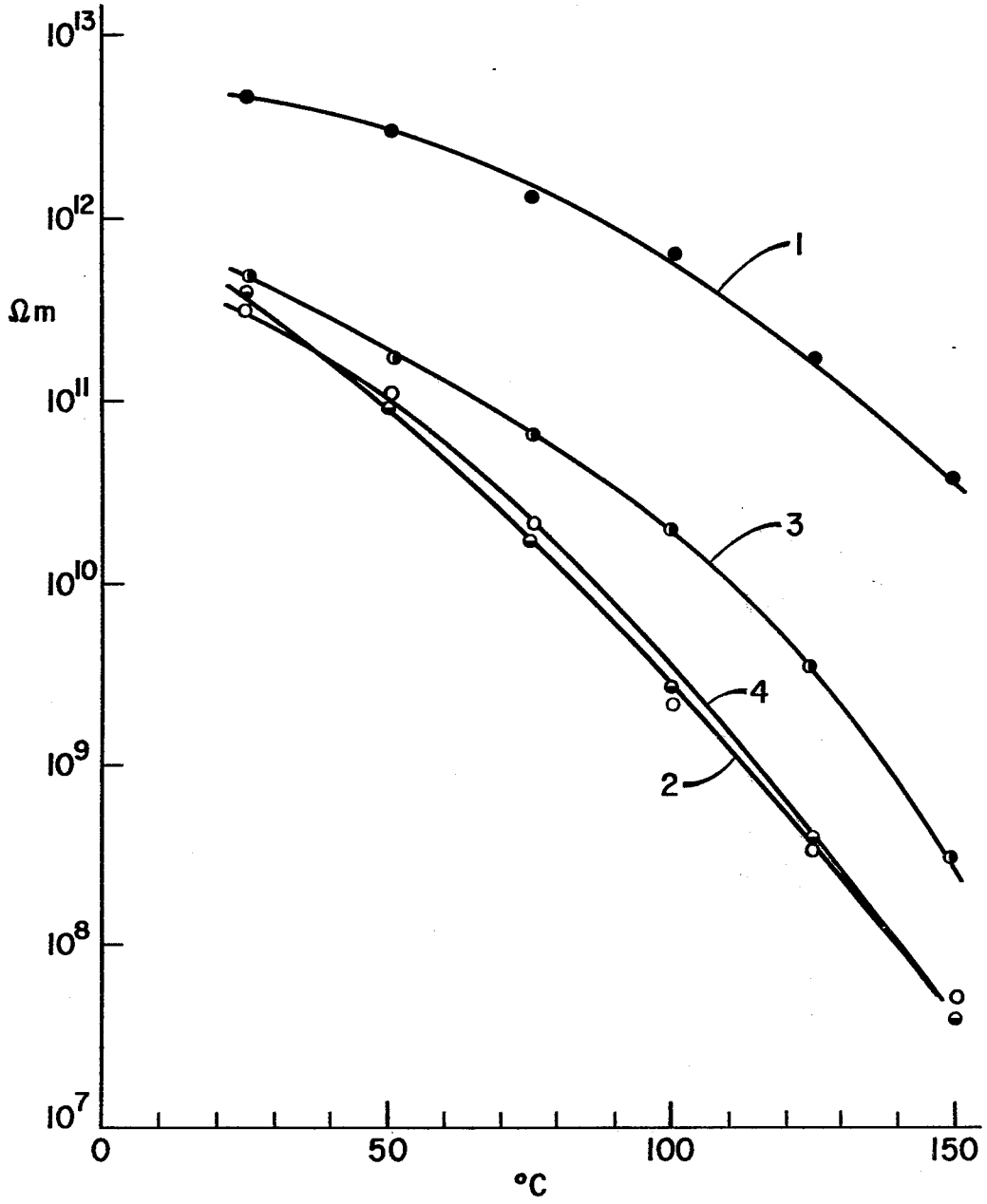
FIGS. 1–3 show the relationships between the volume resistance of the cured compositions and temperature in Examples 1–3, respectively. The vertical axis indicated the volume resistance and the horizontal axis indicates the temperature. In each figure, Curve 1 represents the volume resistance of the cured product of a composition prepared as an example of this invention, Curve 2 represents the volume resistance of the cured product of the composition in which zinc oxide was omitted from the composition of this invention, Curve 3 represents the volume resistance of the cured product of the composition in which the methylhydrogenpolysiloxane was omitted from the composition and Curve 4 represents the volume resistance of the cured product of the resin alone.
Figure 2:
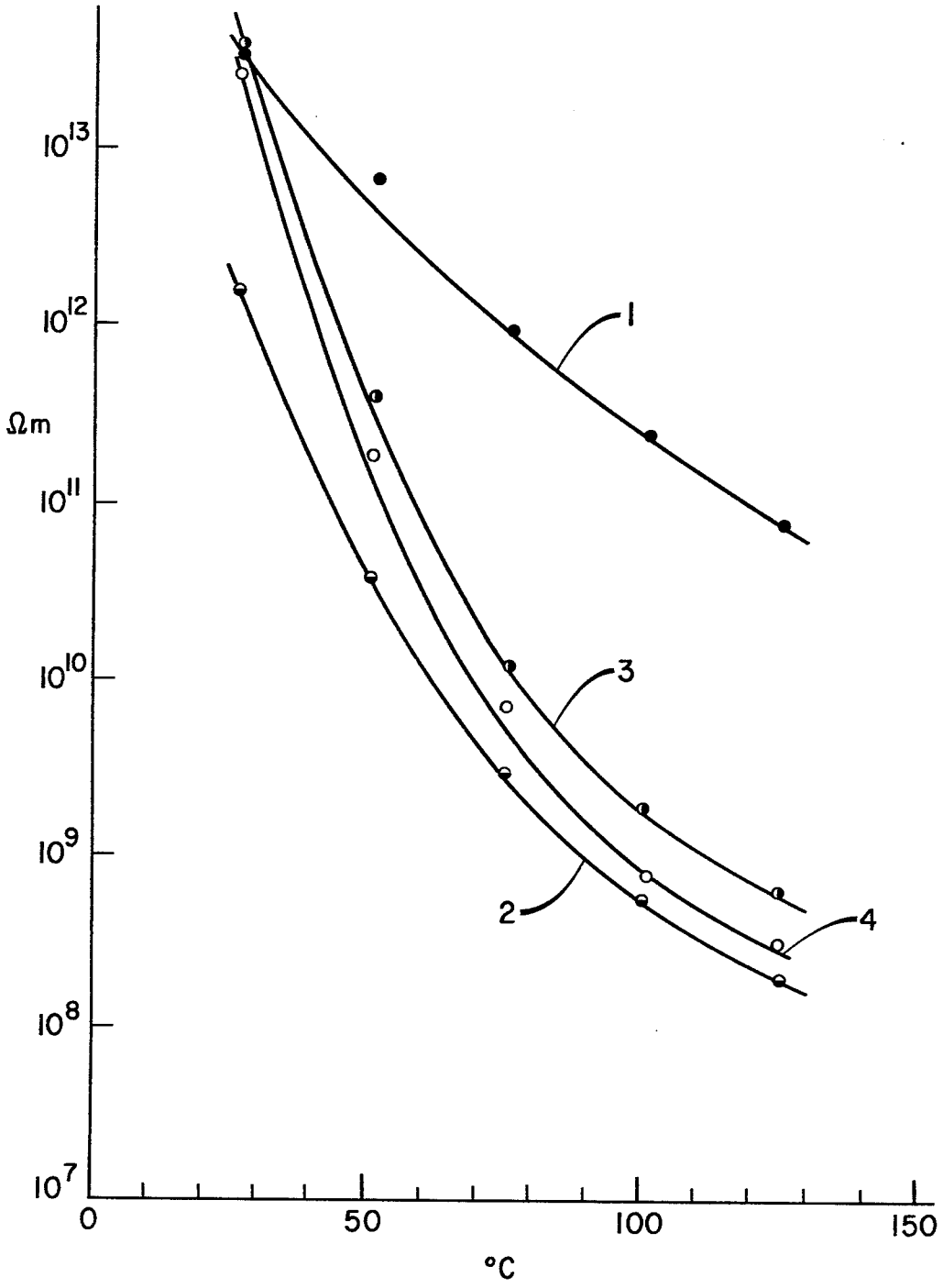
Figure 3:
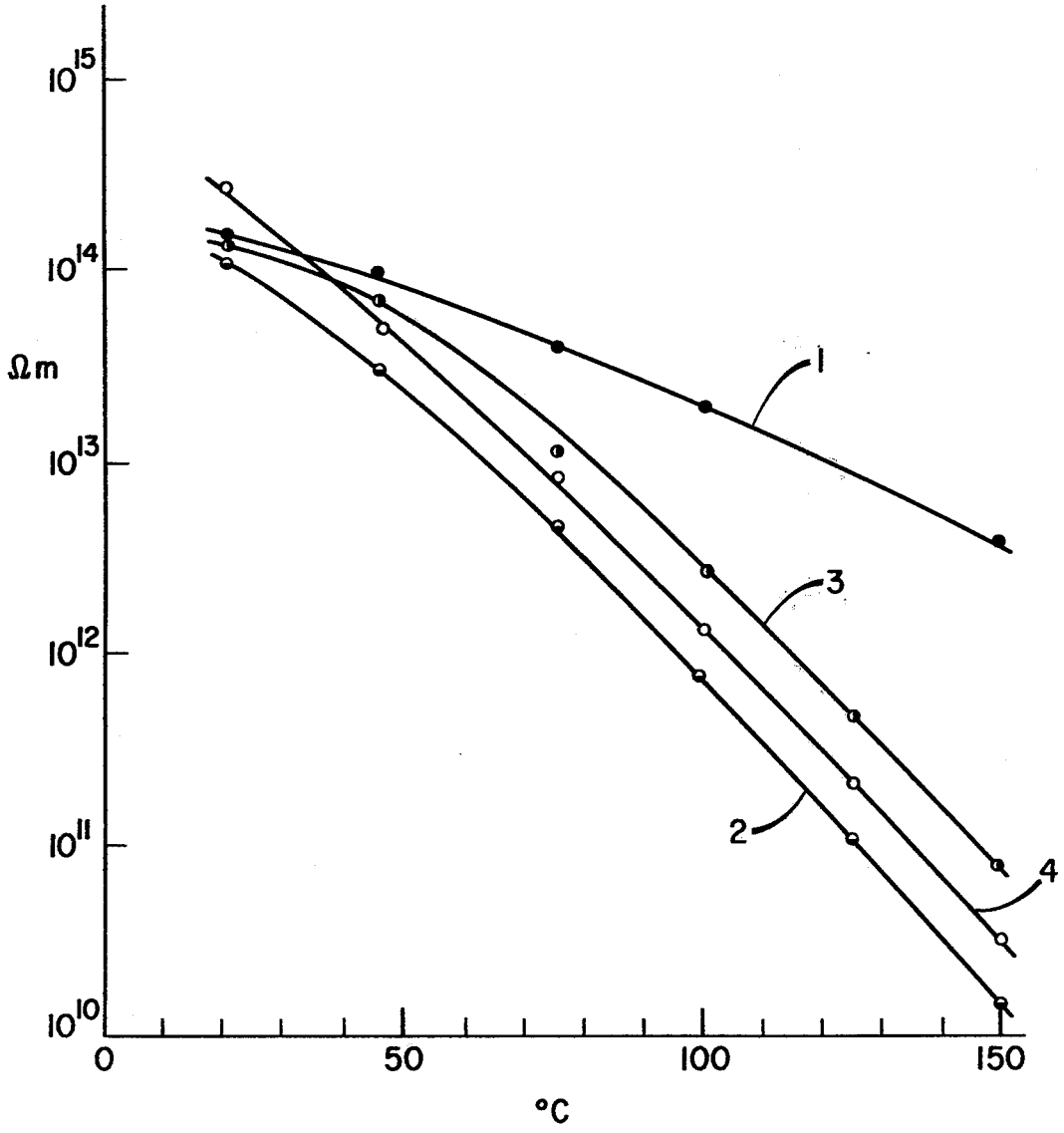

| Composition | Parts Example this invention | Parts Comparison Example | Parts Comparison Example |
|---|---|---|---|
| Ethylene/propylene terpolymer (EPT-3045) | 100 | 100 | 100 |
| Process Oil | 10 | 10 | 10 |
| Zinc Oxide | 50 | 50 | — |
| Methylhydrogen-polysiloxane | 5 | — | — |
| Talc | — | — | 50 |
| Dicumyl peroxide | 4 | 4 | 4 |
| Volume resistance (ohm-meter) | | | |

TABLE I-continued

| Composition | Parts Example this invention | Parts Comparison Example | Parts Comparison Example |
|---|---|---|---|
| 25° C. | $1 \times 10^{14}$ | $2.5 \times 10^{13}$ | $7.5 \times 10^{13}$ |
| 100° C. | $3.5 \times 10^{13}$ | $4.3 \times 10^{12}$ | $2.5 \times 10^{12}$ |
| 130° C. | $8.0 \times 10^{12}$ | $6.5 \times 10^{11}$ | $5.2 \times 10^{11}$ |

TABLE II

| Composition | Parts this invention | Parts Comparison Example |
|---|---|---|
| Polysiloxane rubber | 100 | 100 |
| Zinc Oxide | 30 | 30 |
| Methylhydrogenpolysiloxane | 3 | — |
| 2,4-dichlorobenzoyl peroxide | 2 | 2 |
| Volume resistance (ohm-meter) | | |
| 25° C. | $3.8 \times 10^{14}$ | $2.5 \times 10^{14}$ |
| 100° C. | $1.0 \times 10^{14}$ | $8.2 \times 10^{13}$ |
| 150° C. | $3.2 \times 10^{13}$ | $2.5 \times 10^{12}$ |

That which is claimed is:

1. An electrical insulating material comprising (A) 100 parts by weight of an organic electrical insulating material;

(B) 5–300 parts by weight, based on 100 parts by weight of (A), of zinc oxide powder and, (C) 1–30 weight percent based on the weight of components (B) and (C) of an organosilicon compound in which there is at least one silicon atom having a hydrogen atom bonded thereto.

2. The composition as claimed in claim 1 wherein (A) is a rubber.

3. The composition as claimed in claim 1 wherein (A) is a curable resin.

4. The composition as claimed in claim 1 wherein (A) is a thermoplastic resin.

5. The composition as claimed in claim 1 wherein (B) has an average particle size in the range of from 0.1 to 10 microns.

6. The composition as claimed in claim 1 wherein (B) has a purity exceeding 97 weight percent.

7. A composition as claimed in claim 2 wherein the rubber is a curable silicone rubber.

8. A composition as claimed in claim 3 wherein the curable resin is a silicone resin.

9. The composition as claimed in claim 1 wherein component (C) has the average unit formula $$R_aH_bSiO_{4-a-b/2}$$

wherein R is a substituted or unsubstituted hydrocarbon radical; a has a value of 0 to less than 4 and b has a value of greater than 0 to 4.

10. The composition as claimed in claim 9 wherein component (C) is a linear siloxane.

11. The composition as claimed in claim 9 wherein component (C) is a cyclic siloxane.

12. The composition as claimed in claim 11 wherein the cyclic siloxane is tetramethyltetrahydrogencyclotetrapolysiloxane.

13. The composition as claimed in claim 10 wherein component (C) is a linear methylhydrogenpolysiloxane in which both ends are blocked with trimethylsiloxy groups.

14. The composition as claimed in claim 13 wherein the linear methylhydrogenpolysiloxane has 30 methylhydrogensiloxane units.

* * * * *

UNITED STATES PATENT AND TRADEMARK OFFICE

CERTIFICATE OF CORRECTION

PATENT NO. : 4,243,542

DATED : January 6, 1981

INVENTOR(S) : Katsutoshi Mine

It is certified that error appears in the above-identified patent and that said Letters Patent are hereby corrected as shown below:

In Column 1, line 34; the word "minteral" should read "mineral".

In Column 3, line 2; the formula reading "$R_aH_bSiO_{4-a-b/2}$" should read "$R_aH_bSiO_{\frac{4-a-b}{2}}$".

In Column 3, line 47; the number "30" should read "20".

In Column 8, line 17; the formula reading "$R_aH_bSiO_{4-a-b/2}$" should read "$R_aH_bSiO_{\frac{4-a-b}{2}}$".

Signed and Sealed this

*Fifteenth* Day of *September 1981*

[SEAL]

*Attest:*

GERALD J. MOSSINGHOFF

*Attesting Officer*

*Commissioner of Patents and Trademarks*